US012774850B2

(12) United States Patent
Faisandier et al.

(10) Patent No.: US 12,774,850 B2
(45) Date of Patent: Oct. 27, 2026

(54) COLD BOX AND METHOD OF ASSEMBLY

(71) Applicant: L'Air Liquide, Societe Anonyme pour l'Etude et l'Exploitation des Procedes Georges Claude, Paris (FR)

(72) Inventors: David Faisandier, Sassenage (FR); Guillaume Boye, Sassenage (FR); Yannick Fabre, Sassenage (FR); Pierre-Alexandre Bertrand, Sassenage (FR); Lorieau Fabien, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 186 days.

(21) Appl. No.: 18/854,933

(22) PCT Filed: Mar. 22, 2023

(86) PCT No.: PCT/EP2023/057350
§ 371 (c)(1),
(2) Date: Oct. 7, 2024

(87) PCT Pub. No.: WO2023/194102
PCT Pub. Date: Oct. 12, 2023

(65) Prior Publication Data

US 2026/0251388 A1 Aug. 27, 2026

(30) Foreign Application Priority Data

Apr. 7, 2022 (FR) ..... 2203170

(51) Int. Cl.
*F25J 1/02* (2006.01)

(52) U.S. Cl.
CPC ..... *F25J 1/0259* (2013.01); *F25J 1/0261* (2013.01); *F25J 2290/42* (2013.01)

(58) Field of Classification Search
CPC ..... F25J 1/0259; F25J 1/0261; F25J 2290/42
See application file for complete search history.

(56) References Cited

U.S. PATENT DOCUMENTS 5,349,827 A 9/1994 Bracque et al.
6,711,868 B1 * 3/2004 Faure ..... F25J 3/04945 29/469

(Continued)

FOREIGN PATENT DOCUMENTS

CN 109 140 902 1/2019
DE 20316731 2/2004

(Continued)

OTHER PUBLICATIONS

Fauve, et al, "Ras Lffan Helium Recovery Unit 2," AIP Conference Proceedings, NY, Jan. 1, 2021, pp. 102-109.

(Continued)

*Primary Examiner* — Filip Zec
(74) *Attorney, Agent, or Firm* — Justin K. Murray

(57) ABSTRACT

Cold box configured to house, under vacuum, a collection of pipes and equipment for fluid, and method for assembling same, the cold box comprising a fluid-tight shell delimiting a cylindrical portion extending in a longitudinal direction and the two longitudinal ends of which are each closed by an end wall, wherein the cylindrical portion is split longitudinally into two parts comprising: a lower first part forming a trough that is open at its top, and a cover-forming second part fixed to the upper end of the first part and closing same.

14 Claims, 3 Drawing Sheets

(56) References Cited

U.S. PATENT DOCUMENTS

| | | | | |
|---|---|---|---|---|
| 9,663,257 | B2 * | 5/2017 | Granger | B21D 51/18 |
| 10,088,105 | B2 * | 10/2018 | Rebernik | F17C 3/08 |
| 10,539,361 | B2 * | 1/2020 | Byfield | F25J 1/0259 |
| 10,914,518 | B2 * | 2/2021 | Poulin | F25J 3/0489 |
| 11,215,395 | B2 * | 1/2022 | Cavagne | F25J 3/0295 |
| 2015/0096327 | A1 * | 4/2015 | Lochner | F25J 3/04678 62/643 |
| 2021/0190419 | A1 * | 6/2021 | Voda | F25J 1/0022 |
| 2024/0375226 | A1 * | 11/2024 | Butler | B65D 88/12 |
| 2026/0049763 | A1 * | 2/2026 | Barker | F25J 1/0256 |

FOREIGN PATENT DOCUMENTS

| | | |
|---|---|---|
| DE | 10 2005 022090 | 2/2006 |
| DE | 10 2005 022093 | 2/2006 |

OTHER PUBLICATIONS

International Search Report and Written Opinion for PCT/EP2023/057350, mailed May 12, 2023.
French Search Report for FR 2 203 170, mailed Nov. 22, 2022.

* cited by examiner

[Fig. 1]
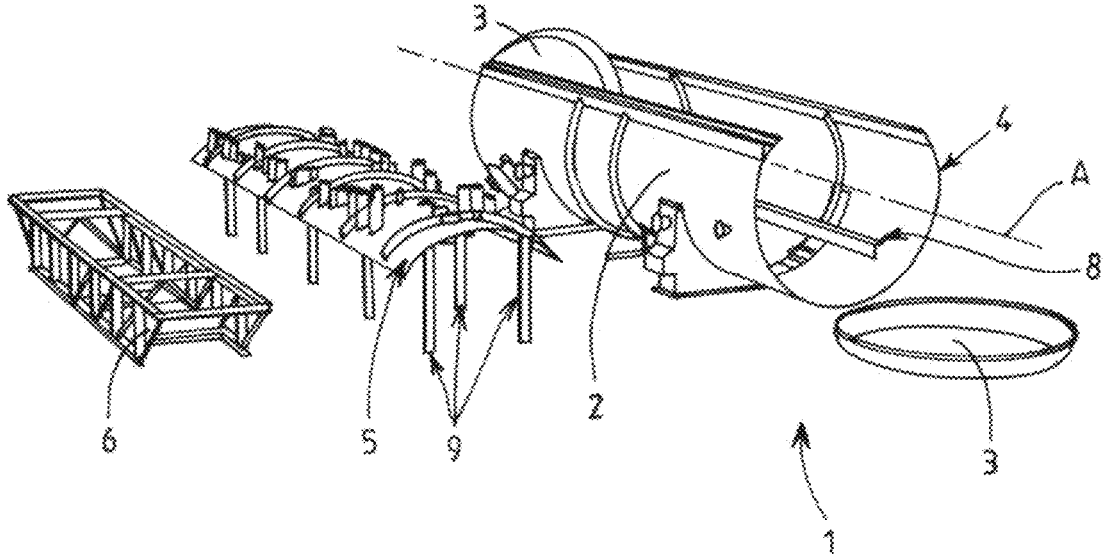
[Fig. 2]
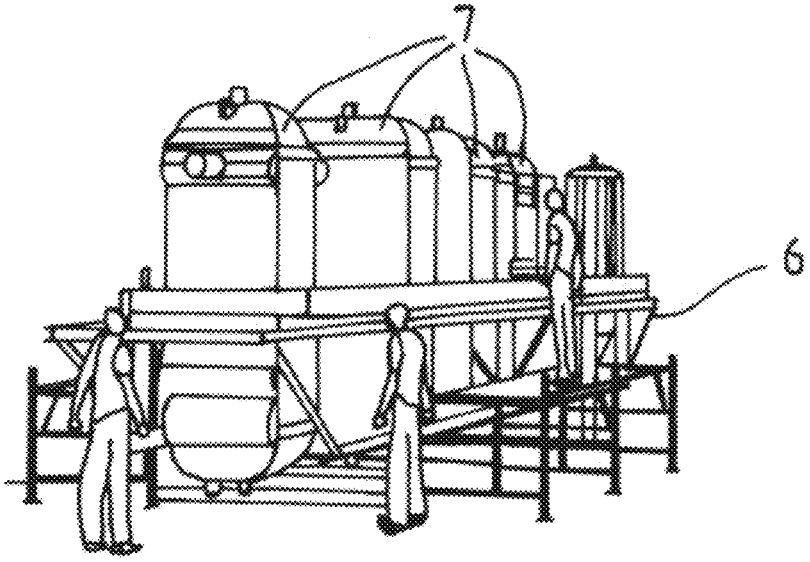

[Fig. 3]
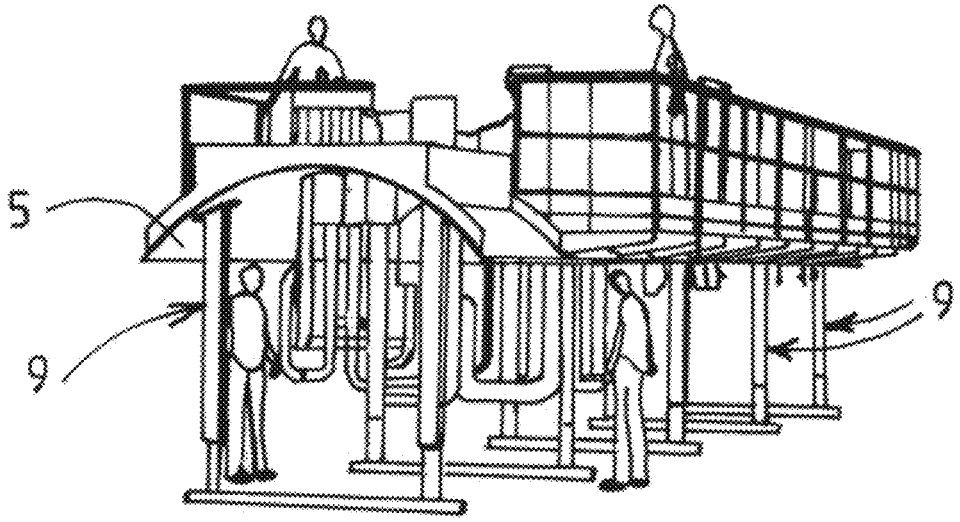
[Fig. 4]
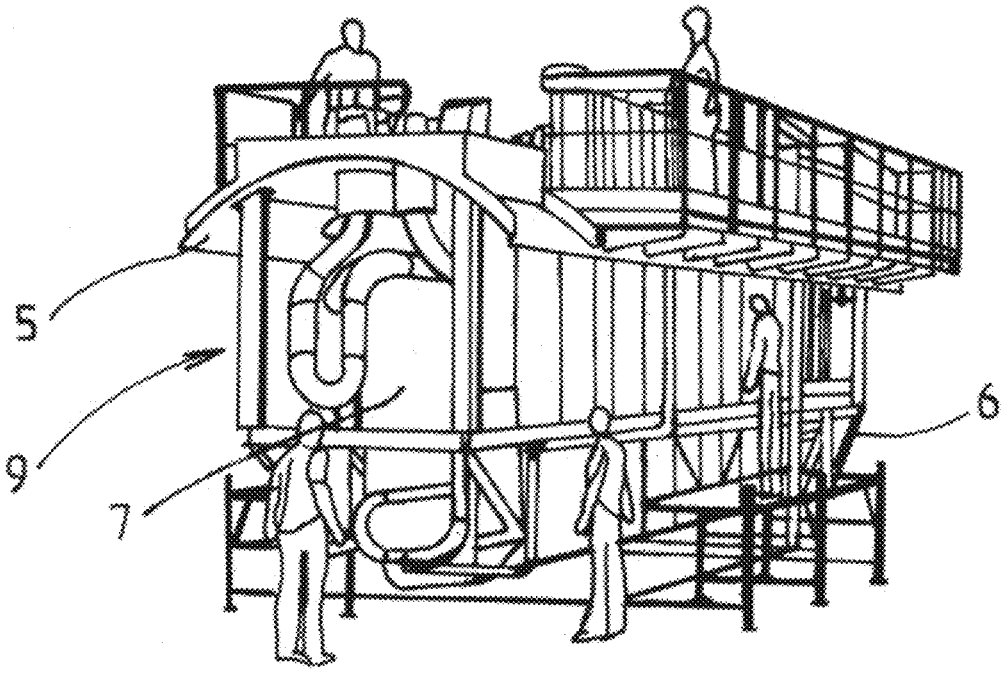

[Fig. 5]
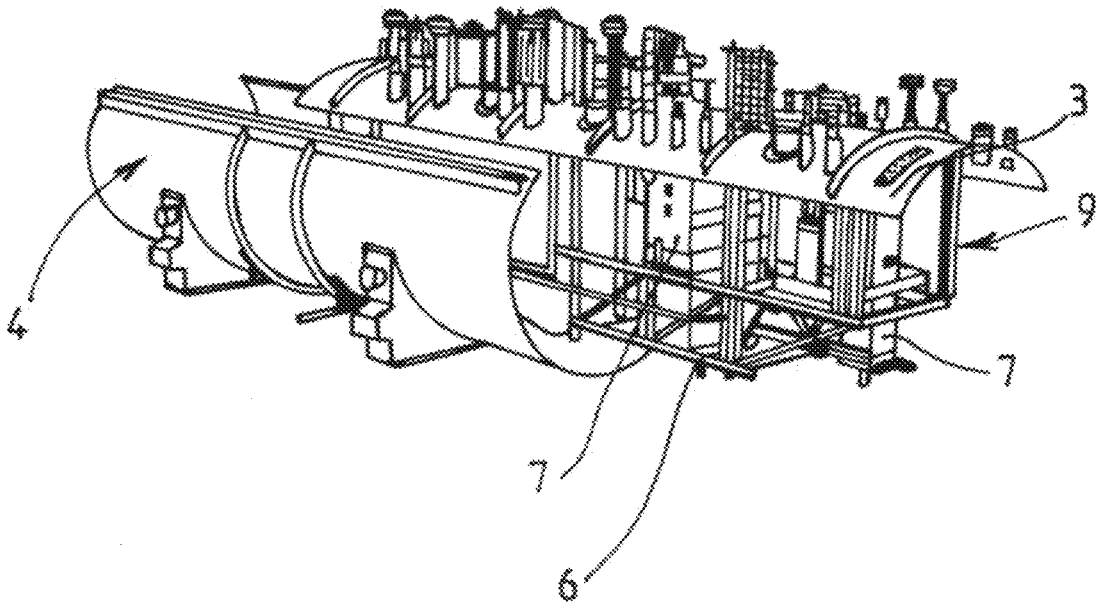
[Fig. 6]
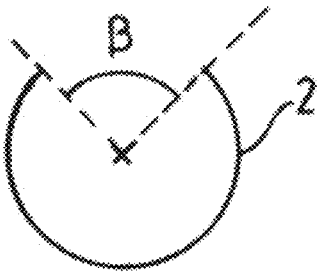

COLD BOX AND METHOD OF ASSEMBLY

CROSS REFERENCE TO RELATED APPLICATIONS

This application is a § 371 of International PCT Application PCT/EP2023/057350, filed Mar. 22, 2023, which claims the benefit of FR2203170, filed Apr. 7, 2022, both of which are herein incorporated by reference in their entireties.

FIELD OF THE INVENTION

The invention relates to a cold box and related assembly method.

The invention relates more specifically to a cold box intended to house a set of fluidic pipes and equipment items under vacuum, the cold box comprising a fluidtight envelope delimiting a cylindrical portion extending in a longitudinal direction, each of the two longitudinal ends of which are closed by an end wall.

The invention relates to cold boxes used in refrigeration installations, notably cryogenic refrigeration installations, in particular for fluid liquefaction and/or cooling installations.

BACKGROUND OF THE INVENTION

An increase in liquefaction capacity combined with a reduction in the size of cold boxes has resulted in an increasingly high filling rate (number of equipment items and pipes in the enclosure) of the vacuum enclosures. Such filling prevents manufacturing operatives from easily accessing the inside. This results in increasingly serious safety problems: isolated worker, confined space, risk of inflammation of insulation in a confined space, etc.

The lack of available space in the cold box has a negative effect on manufacturing and assembly productivity. The number of simultaneous operatives is significantly limited, which increases manufacturing times and the risk of accidents.

It is particularly difficult to install large equipment items (exchanger batteries or large pipes) in the enclosure. Reduced accessibility also impacts manufacturing quality, primarily welding and multilayer insulation (MLI) of the cryogenic lines.

SUMMARY OF THE INVENTION

One aim of the present invention is to overcome all or some of the aforementioned drawbacks of the prior art.

For this purpose, the cold box according to certain embodiments of the invention, the cylindrical portion is cut longitudinally into two parts comprising: a lower first part forming a trough with an open top and a second part forming a cover fastened to the top of the lower first part and closing the latter.

Furthermore, embodiments of the invention may include one or more of the following features:

- the cylindrical portion is cut longitudinally at the top, i.e. above the halfway point of the height of the cylindrical portion measured transversely in the longitudinal direction,
- the cylindrical portion has a circular base,
- in a plane perpendicular to the longitudinal direction, the opening angle of the lower first part of the cylindrical portion measured in relation to the center of the cylindrical portion is between 80° and 180°, and preferably between 90° and 150°,
- the cold box includes a set of equipment items such as one or more heat exchangers, pipes, taps, pipe fixtures, pressurized equipment items, valves, rotary machines mounted on a support chassis, said support chassis being mounted in the lower first part of the cylindrical portion,
- the support chassis is fastened to one or more supports located on the bottom inside the lower first part of the cylindrical portion, notably at least one of the following: a set of rails, a set of intermittent fastening points,
- the support chassis is rigidly connected to the cover and this assembly is fastened to the lower first part of the cylindrical portion,
- the support chassis has a lattice structure,
- the support chassis is mounted in the lower first part of the cylindrical portion perpendicular to the longitudinal direction A,
- the cold box includes a set of circuits and/or valves and/or rotary machines and/or electric bushings mounted on the cover and passing through the cover via fluidtight passages,
- the set of circuits assembled through the cover is connected to the set of equipment items of the support chassis,
- an inner face of the cover is rigidly connected to a set of structural mechanical joining elements, such as shafts, connected mechanically to the set of equipment items and/or to the support chassis of the lower first part of the cylindrical portion,
- when the cold box is in the usage position, the longitudinal direction is horizontal or vertical.

The invention also relates to a method for assembling a cold box made up of a fluidtight envelope delimiting a cylindrical portion extending in a longitudinal direction and two end walls provided to close the longitudinal ends of the cylindrical portion, the cylindrical portion being cut longitudinally into two parts comprising: a lower first part forming a trough with an open top and a second part forming a cover intended to be fastened to the top of the lower first part and closing the latter, the method comprising a step of mounting a set of fluidic equipment items such as one or more heat exchangers, pipes, taps, pipe fixtures, pressurized equipment items, valves, turbines, rotary machines in the lower first part (4) of the cylindrical portion, a step of mounting a set of circuits and possibly equipment items on the cover through fluidtight passages, a step of sealing the cylindrical portion with the cover and two end walls.

The invention may also relate to any alternative device or method comprising any combination of the features above or below within the scope of the claims.

Further particular features and advantages will become apparent upon reading the following description, which is provided with reference to the figures, in which:

BRIEF DESCRIPTION OF THE DRAWINGS

The invention will be understood better from reading the following description, which is given solely by way of example and with reference to the appended drawings, in which:

FIG. 1 is a schematic perspective view of an example cold box structure in a disassembled state, FIG. 2 is a schematic perspective view of an example of a first part of the cold box according to the invention during assembly, FIG. 3 is a schematic perspective view of an example of a second part of the cold box according to the invention during assembly, FIG. 4 is a schematic perspective view of assembly of the first and second parts during assembly, FIG. 5 is a schematic perspective view of the assembly of the first and second parts assembled in a third part of the cold box during assembly, FIG. 6 is a partial schematic view of a section of the lower part of the cylindrical portion of the cold box.

DETAILED DESCRIPTION OF THE INVENTION

The cold box 1 illustrated is intended to house a set of fluidic equipment items and pipes, notably cryogenic, i.e. operating at a temperature less than −100° C.

The cold box 1 comprises a fluidtight envelope 2 (for example made of metal) delimiting a cylindrical portion extending in a longitudinal direction A, preferably having a circular base, in which each of the two longitudinal ends are closed by an end wall 3 (for example convex walls). This cylindrical shape with a circular base is particularly suited to vacuum storage.

This illustrated cold box 1 is a horizontal cold box, i.e. the longitudinal direction A is horizontal when the cold box is in the usage position. Naturally, the invention can also apply to a vertical cold box.

According to an advantageous feature, the cylindrical portion 2 (or at least a part thereof) is cut longitudinally into two parts comprising: a lower first part 4 forming a trough with an open top and a second part forming a cover 5 fastened to the top of the lower first part 4 and sealing the latter. These different parts can for example by made by sheet metal work.

The cylindrical portion 2 can be cut longitudinally halfway up and preferably at the top, i.e. above the halfway point of the height of the cylindrical portion measured transversely in the longitudinal direction A.

For example and as shown schematically in [FIG. 6] in a plane perpendicular to the longitudinal direction A, the opening angle B of the lower part of the cylindrical portion measured in relation to the center of the cylindrical portion is preferably between 80° and 180°, and even more preferably between 90° and 150°. This enables the equipment items to be rigidly connected to the chassis 6 and to the cover 5 on this trough, providing good accessibility during integration. This structure also affords a certain degree of flexibility for final welding work.

The proposed solution thus provides the tubular portion in parts or two "half shells". The two parts are notably welded longitudinally once the internal elements have been mounted in the internal volume (final welding, for example).

This means that the two parts are welded once the cold box has been assembled. The internal elements (equipment items, etc.) can thus be integrated before assembly of the two parts, for example on a support chassis 6 that may be rigidly connected to the cover 5 instead of being inserted longitudinally into a closed tube, as is the case in the prior art.

Equipment items may be mounted on the support chassis 6 (see [FIG. 2]). The support chassis 6 may have a lattice structure.

Similarly, equipment items and/or pipes may be mounted on the top part 5 (cover) (see [FIG. 3]). For example, a set of circuits is mounted on the cover 5 and passes through the cover 5 via fluidtight passages. This optimizes the position of the interfaces, ensuring that the majority of the interfaces are located on this top half-shell or cover 5.

These two sub-parts may be assembled (see [FIG. 4]). In this case, the set of circuits assembled through the cover 5 may be connected to the set of equipment items 7 of the support chassis 6.

For this purpose, the inner face of the cover 5 may be rigidly connected to a set of structural or mechanical connection members 9, such as shafts, posts, rods or the like, that are distributed longitudinally and that project to be connected mechanically at least to the support chassis 6.

The assembly comprising the cover 5 and the support chassis 6 can then be fastened to one or more supports 8, preferably temporary supports, located on the bottom inside the lower part 4 of the cylindrical portion. This means that these supports 8 may be provided for the operatives.

For example, the assembly comprising the support chassis 6 and the cover 5 is inserted vertically into the lower part 4 and is placed on the supports in the bottom of the lower part 4. The internal chassis has one or more static points/sliding points with the enclosure. These static and sliding points may be selected to limit the thermal stresses on the support chassis 6 and/or on the equipment items 7 of the cold box 1.

It should be noted that the cylindrical lower part 4 may or may not be provided in advance with a bottom 3 (end wall).

This structure, and notably the chassis 6, significantly reinforces the top part 5 for subsequent operations.

This structure and the use thereof facilitate assembly of the equipment items in the enclosure.

The solution reduces manufacturing time and improves the safety of manufacturing operations. The work to integrate the equipment items and circuits can be carried out in parallel on the different parts.

The chassis 6 can simplify installation of heavy equipment items. Tools for integrating equipment items into the enclosure are no longer required since the chassis can carry most of the internal equipment items. At the beginning of the operations, the chassis 6 may be separate from the lower part 4 and the top part 5 of the enclosure.

This structure enables assembly operations to be carried out in a workshop, in an open environment, with good accessibility and good lighting, which are very useful for integration and also for inspection.

Mechanical reinforcements may be provided on the top part 5 around the static points, and around the handling points.

Safety is significantly improved, and work to be carried out inside the closed enclosure are reduced to a strict minimum. More operatives can be used, which, combined with better accessibility, helps to reduce costs and lead times. Pipelines can be integrated in longer sections, which reduces the number of welds and reworking of the insulation. Final quality is improved, with a lower risk of leakage and improved thermal efficiency. The structure significantly simplifies installation of pipe supports.

Although this detailed description refers to one or more embodiments, this does not mean that the features apply only to a single embodiment. Simple characteristics of different embodiments can also be combined and/or interchanged in order to provide other embodiments within the context of the claims.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A cold box configured to a set of fluidic pipes and equipment items under vacuum, the cold box comprising: a fluidtight envelope delimiting a cylindrical portion extending in a longitudinal direction, each of the two longitudinal ends of which are closed by an end wall, the cylindrical portion being cut longitudinally into two parts comprising: a lower first part forming a trough with an open top and a second part forming a cover fastened to the top of the first part and closing the latter, wherein the cylindrical portion is cut longitudinally at a location above the halfway point of the height of the cylindrical portion measured transversely in the longitudinal direction, and wherein, in a plane perpendicular to the longitudinal direction, an opening angle of the lower first part of the cylindrical portion measured in relation to the center of the cylindrical portion is between 90° and 150°.

2. The cold box as claimed in claim 1, wherein the cylindrical portion has a circular base.

3. The cold box as claimed in claim 1, further comprising a set of equipment items such as one or more heat exchangers, pipes, taps, pipe fixtures, pressurized equipment items, valves, rotary machines mounted on a support chassis, said support chassis being mounted in the lower first part of the cylindrical portion.

4. The cold box as claimed in claim 3, wherein the support chassis is fastened to one or more supports located on the bottom inside the lower first part of the cylindrical portion, notably at least one of the following: a set of rails, a set of intermittent fastening points.

5. The cold box as claimed in claim 4, wherein the support chassis is rigidly connected to the cover and this assembly is fastened to the lower first part of the cylindrical portion.

6. The cold box as claimed in claim 3, wherein the support chassis has a lattice structure.

7. The cold box as claimed in claim 3, wherein the support chassis is mounted in the lower first part of the cylindrical portion perpendicular to the longitudinal direction.

8. The cold box as claimed in claim 1, further comprising a set of circuits and/or electric bushings mounted on the cover and passing through the cover via fluidtight passages.

9. The cold box as claimed in claim 8, further comprising a set of equipment items such as one or more heat exchangers, pipes, taps, pipe fixtures, pressurized equipment items, valves, rotary machines mounted on a support chassis, said support chassis being mounted in the lower first part of the cylindrical portion, wherein the set of circuits assembled through the cover is connected to the set of equipment items of the support chassis.

10. The cold box as claimed in claim 8, wherein an inner face of the cover is rigidly connected to a set of structural mechanical joining elements, connected mechanically to the set of equipment items and/or to the support chassis of the lower first part of the cylindrical portion.

11. The cold box as claimed in claim 1, wherein when the cold box is in the usage position, the longitudinal direction is horizontal or vertical.

12. A method for assembling a cold box made up of a fluidtight envelope delimiting a cylindrical portion extending in a longitudinal direction and two end walls provided to close the longitudinal ends of the cylindrical portion, the cylindrical portion being cut into two parts comprising: a lower first part forming a trough with an open top and a second part forming a cover intended to be fastened to the top of the lower first part and closing the latter, the method comprising the steps of:

mounting a set of fluidic equipment items such as one or more heat exchangers, pipes, taps, pipe fixtures, pressurized equipment items, valves, turbines, rotary machines in the lower first part of the cylindrical portion;

mounting a set of circuits and possibly equipment items on the cover through fluidtight passages;

sealing the cylindrical portion with the cover and two end walls, the cylindrical portion is cut longitudinally at a location that is above the halfway point of the height of the cylindrical portion measured transversely in the longitudinal direction, and wherein in a plane perpendicular to the longitudinal direction, the opening angle of the lower first part of the cylindrical portion measured in relation to the center of the cylindrical portion is between 90° and 150°.

13. The method as claimed in claim 12, wherein, during the step of mounting the set of fluidic equipment items in the lower first part of the cylindrical portion, the set of fluidic equipment items is mounted on a support chassis that is mounted in the lower part of the cylindrical portion.

14. The method as claimed in claim 12, wherein the support chassis is inserted vertically into the lower first part of the cylindrical portion.

* * * * *